US010791394B1

(12) United States Patent
Zastoupil

(10) Patent No.: US 10,791,394 B1
(45) Date of Patent: Sep. 29, 2020

(54) LOUDSPEAKER WITH WAVEGUIDE

(71) Applicant: Bose Corporation, Framingham, MA (US)

(72) Inventor: Greg Joseph Zastoupil, North Grafton, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/296,305

(22) Filed: Mar. 8, 2019

(51) Int. Cl.

| | |
|---|---|
| ***H04R 1/34*** | (2006.01) |
| ***H04R 7/12*** | (2006.01) |
| ***H04R 9/06*** | (2006.01) |
| ***H04R 1/30*** | (2006.01) |

(52) U.S. Cl.
CPC ..... *H04R 1/34* (2013.01); *H04R 1/30* (2013.01); *H04R 1/345* (2013.01); *H04R 7/127* (2013.01); *H04R 9/06* (2013.01); *H04R 2201/34* (2013.01); *H04R 2400/13* (2013.01)

(58) Field of Classification Search
CPC . H04R 1/30; H04R 1/34; H04R 1/345; H04R 9/02; H04R 9/06; H04R 2201/34; H04R 2400/13
USPC ..... 381/337, 339, 340, 341, 342, 343; 181/152, 159, 192, 194, 195
See application file for complete search history.

(56) References Cited

U.S. PATENT DOCUMENTS

| | | | | |
|---|---|---|---|---|
| 2,638,510 | A * | 5/1953 | Brami | H04R 1/30 381/341 |
| 2,858,377 | A * | 10/1958 | Levy | H04R 1/30 381/341 |
| 3,867,586 | A | 2/1975 | Maekawa et al. | |
| 4,525,604 | A * | 6/1985 | Frye | H04R 9/02 181/152 |
| 7,039,211 | B2 | 5/2006 | Werner | |
| 7,134,523 | B2 | 11/2006 | Engebretson | |
| 7,873,178 | B2 | 1/2011 | Steere et al. | |
| 8,036,408 | B2 | 10/2011 | Voishvillo | |
| 8,077,897 | B2 | 12/2011 | Voishvillo | |
| 8,130,994 | B2 | 3/2012 | Button et al. | |
| 8,181,736 | B2 | 5/2012 | Sterling et al. | |
| 8,280,091 | B2 | 10/2012 | Voishvillo | |
| 8,418,802 | B2 | 4/2013 | Sterling et al. | |
| 8,607,922 | B1 | 12/2013 | Werner | |

(Continued)

FOREIGN PATENT DOCUMENTS

JP S54172730 U 12/1979

OTHER PUBLICATIONS

PCT International Search Report and Written Opinion for International Application No. PCT/US2020/019622, dated May 4, 2020, 20 pages.

*Primary Examiner* — Huyen D Le
(74) *Attorney, Agent, or Firm* — Hoffman Warnick LLC

(57) ABSTRACT

Various implementations include loudspeakers. In some particular cases, a loudspeaker includes: a diaphragm; a basket; an electro-magnetic motor supported by the basket and coupled to the diaphragm for driving motion of the diaphragm relative to the basket along a motion axis; a surround coupling an outer peripheral edge of the diaphragm to the basket; and a waveguide coupled to the basket and surrounding the diaphragm. The waveguide has an arcuate inner surface that is complementary with an arcuate outer surface of the diaphragm and extends along a portion of the arcuate outer surface of the diaphragm.

17 Claims, 4 Drawing Sheets

(56) References Cited

U.S. PATENT DOCUMENTS

| | | | |
|---|---|---|---|
| 8,649,544 | B2 | 2/2014 | Voishvillo |
| 8,672,088 | B2 | 3/2014 | Sterling et al. |
| 9,571,923 | B2 | 2/2017 | Spillmann et al. |
| 10,038,954 | B2 | 7/2018 | Voishvillo |
| 2005/0175207 | A1 | 8/2005 | Alexander et al. |
| 2017/0195783 | A1 | 7/2017 | Gladwin et al. |

* cited by examiner

LOUDSPEAKER WITH WAVEGUIDE

TECHNICAL FIELD

This disclosure generally relates to loudspeakers. More particularly, the disclosure relates to a loudspeaker having a waveguide for controlling sound radiation patterns relative to the size of the loudspeaker source.

BACKGROUND

There is an increasing demand for high-powered loudspeakers. However, higher-powered speakers require transducers with ever larger voice coils. The larger voice coil corresponds with a larger dome tweeter, which at high frequencies, creates a larger source and a narrower beamwidth as compared with a lower power-rated loudspeaker with a smaller dome tweeter.

SUMMARY

All examples and features mentioned below can be combined in any technically possible way.

Various implementations include loudspeakers and related drivers. The loudspeakers and drivers can include a waveguide that extends along the arcuate outer surface of the speaker diaphragm.

In some particular aspects, a loudspeaker includes: a diaphragm; a basket; an electro-magnetic motor supported by the basket and coupled to the diaphragm for driving motion of the diaphragm relative to the basket along a motion axis; a surround coupling an outer peripheral edge of the diaphragm to the basket; and a waveguide coupled to the basket and surrounding the diaphragm. The waveguide has an arcuate inner surface that is complementary with an arcuate outer surface of the diaphragm and extends along a portion of the arcuate outer surface of the diaphragm.

In another aspect, a high frequency (HF) driver includes: a diaphragm; a basket; a surround coupling an outer peripheral edge of the diaphragm to the basket and protruding from an outer surface of the basket; and a waveguide coupled with the basket and surrounding the diaphragm. The waveguide includes: an arcuate inner surface that is complementary with an arcuate outer surface of the diaphragm and overlies a portion of the arcuate outer surface of the diaphragm, such that the outer peripheral edge of the diaphragm is visually obstructed by the waveguide from a front of the loudspeaker.

In an additional aspect, a loudspeaker includes: a waveguide having a centrally located aperture; and a tweeter mounted within the aperture, the tweeter having a dome-shaped acoustic radiating surface. The aperture is configured such that the waveguide overlies a peripheral edge of the dome-shaped acoustic radiating surface of the tweeter.

Implementations may include one of the following features, or any combination thereof.

In some cases, the waveguide further includes an outer surface that extends beyond the outer peripheral edge of the diaphragm.

In particular aspects, the waveguide overhangs the surround.

In certain implementations, a core of the waveguide overhangs the surround. The core has a height as measured from the outer surface of the basket in a direction parallel with the motion axis that is equal to approximately 35 percent to approximately 85 percent of a height of the diaphragm as measured from the outer surface of the basket in the axial direction.

In certain cases, the surround is visually obstructed by the waveguide from a front of the loudspeaker.

In particular implementations, the arcuate inner surface of the waveguide is separated from the arcuate outer surface of the diaphragm by a distance of approximately 0.25 millimeters (mm) to approximately 0.75 mm when the diaphragm is in its rest position.

In some aspects, the arcuate inner surface of the waveguide extends along approximately 5 percent to approximately 40 percent of the outer surface of the diaphragm.

In particular cases, the diaphragm includes a dome-shaped radiating surface.

In certain implementations, the loudspeaker includes a high frequency (HF) driver.

In certain aspects, the aperture is defined by an arcuate surface that extends from a first open end having a first diameter to a second open end having a second diameter that is smaller than the first open end. The arcuate surface has a curvature that corresponds to a curvature of the dome-shaped acoustic radiating surface.

In particular implementations, the second diameter is smaller than a diameter of the peripheral edge of the dome-shaped acoustic radiating surface of the tweeter.

In some cases, the tweeter further includes a suspension element that radially surrounds and is coupled to the peripheral edge of the dome-shaped acoustic radiating surface. The waveguide overlies the suspension element, and where the first diameter is smaller than a diameter of an outer peripheral edge of the suspension element.

Two or more features described in this disclosure, including those described in this summary section, may be combined to form implementations not specifically described herein.

The details of one or more implementations are set forth in the accompanying drawings and the description below. Other features, objects and benefits will be apparent from the description and drawings, and from the claims.

Figure 1:
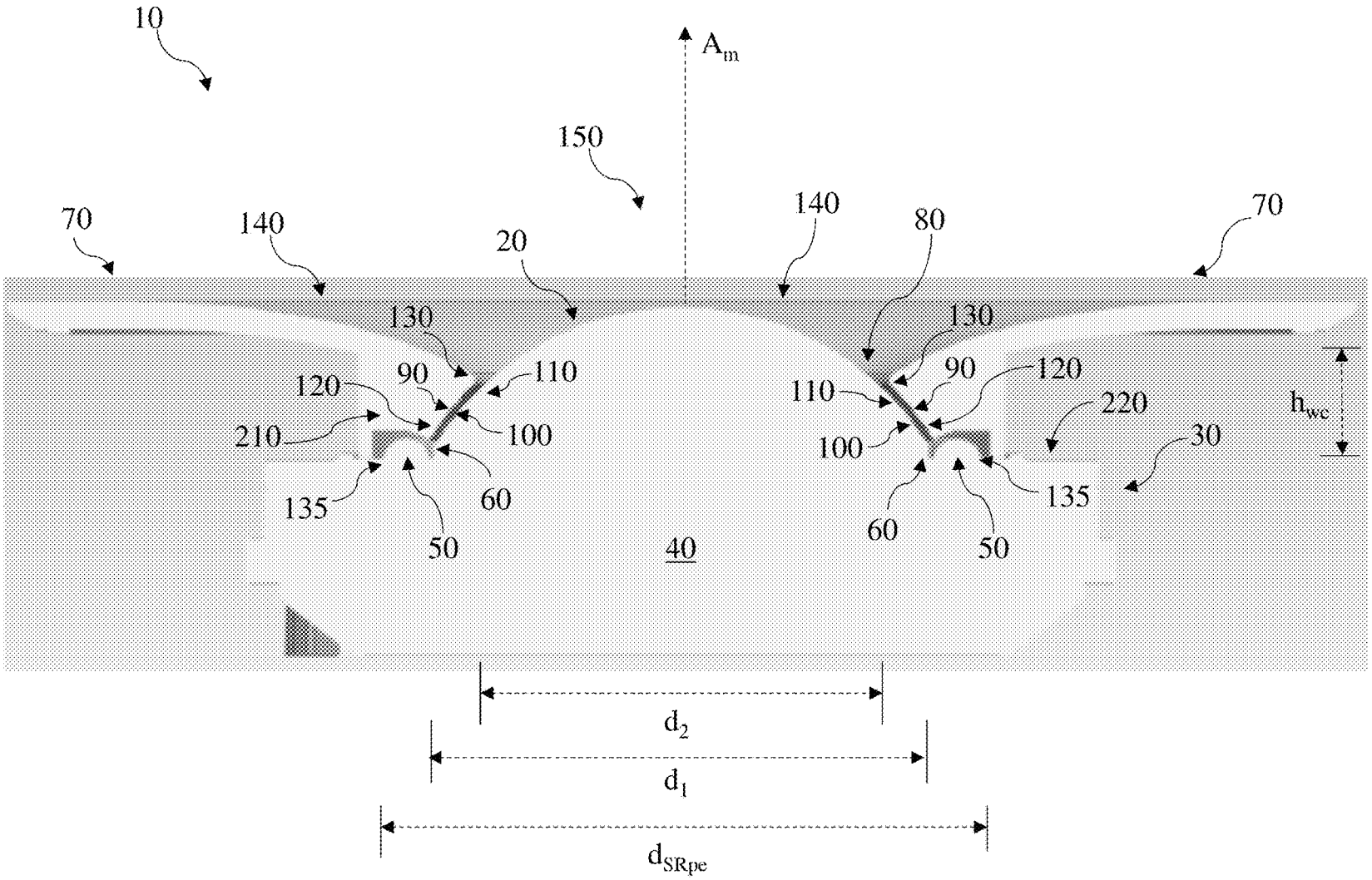
FIG. 1 shows a cut-away perspective view of a loudspeaker according to various implementations.

It is noted that the drawings of the various implementations are not necessarily to scale. The drawings are intended to depict only typical aspects of the disclosure, and therefore should not be considered as limiting the scope of the implementations. In the drawings, like numbering represents like elements between the drawings.

DETAILED DESCRIPTION

This disclosure is based, at least in part, on the realization that a waveguide can be beneficially incorporated into a loudspeaker to control the loudspeaker's radiation pattern. For example, a loudspeaker having a waveguide can provide a desired radiation pattern in certain applications, such as low-profile applications.

Commonly labeled components in the FIGURES are considered to be substantially equivalent components for the purposes of illustration, and redundant discussion of those components is omitted for clarity. Numerical ranges and values described according to various implementations are merely examples of such ranges and values, and are not intended to be limiting of those implementations. In some cases, the term "approximately" is used to modify values, and in these cases, can refer to that value+/−a margin of error, such as a measurement error, which may range from up to 1-3 percent.

As described herein, as the size of the high frequency (HF) driver (or, tweeter) in a loudspeaker increases, the corresponding change in the radiation pattern can create acoustic challenges. For example, in low profile applications such as flush-mounted or surface-mounted speaker designs, loudspeaker system designers must attempt to provide desired radiation patterns while meeting higher frequency requirements of larger speakers (e.g., at frequencies of 8 kilohertz (kHz) or greater).

In contrast to conventional systems, the loudspeakers disclosed according to various implementations have a waveguide coupled to the loudspeaker basket that surrounds the speaker diaphragm and has an arcuate inner surface that is complementary with an arcuate outer surface of the diaphragm. The waveguide extends along a portion of the arcuate outer surface of the diaphragm and can control the width of the loudspeaker's radiation pattern. These implementations provide a loudspeaker with a higher power rating (and larger dome tweeter) than smaller dome tweeters, with improved performance at low frequencies relative to those smaller dome tweeters. Additionally, the loudspeakers disclosed according to various implementations integrate the larger dome tweeter in a low profile configuration.

FIG. 1 shows a cut-away perspective view of a loudspeaker 10 according to various implementations. In some particular cases, the loudspeaker 10 includes a high frequency (HF) driver, also referred to as a tweeter. However, it is understood that the loudspeaker 10 can be configured to operate at one or more frequency ranges that fall within the mid to low-frequency range.

According to various implementations, the loudspeaker 10 includes a diaphragm 20, a basket 30, and an electromagnetic motor (motor) 40 supported by the basket 30 and coupled to the diaphragm 20. In particular cases, the diaphragm 20 can include a dome-shaped radiating surface, however, it is understood that in additional implementations, the diaphragm 20 may take other conventional speaker shapes (e.g., cone, horn, etc.). The basket 30 houses the motor 40, which is configured to drive motion of the diaphragm 20 relative to the basket 30 along a motion axis ($A_m$). Some details of the basket 30 and motor 40 are omitted in this depiction. The loudspeaker 10 also includes a surround (or, suspension element) 50 coupling an outer peripheral edge 60 of the diaphragm 20 to the basket 30. The surround 50 helps to control movement of the diaphragm 20 relative to the basket 30 as it is driven by the motor 40.

In various implementations, the loudspeaker 10 also includes a waveguide 70 coupled to the basket 30 and surrounding the diaphragm 20. In certain cases, the waveguide 70 has a centrally located aperture 80 that is sized to mount the diaphragm 20, basket 30 and the motor 40. That is, the diaphragm 20 is sized to fit in the centrally located aperture 80, such that the waveguide 70 overlies the (outer) peripheral edge 60 of the diaphragm 20.

As described according to various implementations, and in contrast to conventional loudspeakers, the waveguide 70 has an arcuate inner surface 90 that is complementary with an arcuate outer surface 100 of the diaphragm 20. That is, the arcuate inner surface 90 of the waveguide 20 has a curvature that corresponds to a curvature of the dome-shaped acoustic radiating surface of the diaphragm 20. In particular implementations, when the diaphragm 20 is in its rest position, the arcuate inner surface 90 of the waveguide 20 is separated from the arcuate outer surface 100 of the diaphragm 20, for example, by a distance of approximately 0.25 millimeters (mm) to approximately 0.75 mm, and in some particular examples, by a distance of approximately 0.5 mm.

In addition to overlying the peripheral edge 60 of the diaphragm 20, the arcuate inner surface 90 of the waveguide 70 also extends along a portion 110 of the arcuate outer surface 100 of the diaphragm 20. In particular examples, the arcuate inner surface 90 of the waveguide 70 extends along approximately 5 percent to approximately 40 percent (in some particular cases, approximately 25 percent) of the outer surface 100 of the diaphragm 20.

In various implementations, the aperture 80 is defined by the arcuate inner surface 90 of the waveguide 70. That is, the arcuate inner surface 90 extends from a first open end 120 having a first diameter ($d_1$) to a second open end 130 having a second diameter ($d_2$). In various implementations, the second diameter ($d_2$) is smaller than the first diameter ($d_1$), which may be approximately equal to a diameter of the peripheral edge 60 of the dome-shaped acoustic radiating surface of the diaphragm 20. As shown in FIG. 1, in additional particular cases, the first diameter ($d_1$) is smaller than a diameter ($d_{SRpe}$) of an outer peripheral edge 135 of the suspension element 50.

In certain cases, as shown in FIG. 1, the waveguide 70 includes an outer surface 140 that extends radially beyond the outer peripheral edge 90 of the diaphragm 20 (i.e., in a direction perpendicular to the motion axis ($A_m$)). In additional cases, a portion of the outer surface 140 of the waveguide 70 is forward of the apex of the dome-shaped acoustic radiating surface of the diaphragm 20 as measured along the motion axis ($A_m$)). That is, this portion of the outer surface 140 is closer to the front 150 of the loudspeaker 10 than the apex of the dome-shaped acoustic radiating surface of the diaphragm 20. These features of the loudspeaker 10 are additionally illustrated in FIGS. 2A and 2B, which show a cut-away perspective view of a conventional waveguide 200 (in FIG. 2A), and a cut-away perspective view of loudspeaker 10 overlain with the conventional waveguide 200 (in FIG. 2B). FIG. 3 shows an additional cut-away perspective view of the loudspeaker 10 as compared with the conventional waveguide 200.

In various implementations, the waveguide 70 has a taper angle ($\alpha_t$) that defines the radiation pattern of the loudspeaker 10 (FIG. 3). That is, the waveguide 70 tapers along its outer surface 140, for example, at an angle of approximately 20 degrees to approximately 40 degrees, and in some particular examples, approximately 30 degrees. As compared with the conventional waveguide 200, this taper angle ($\alpha_t$), in some examples, is approximately 30 percent to approximately 160 percent greater than the comparable taper angle (e.g., of approximately 15 degrees) when measured from the surface of the diaphragm 20 to the outermost point on the outer surface 140.

Figure 2A:
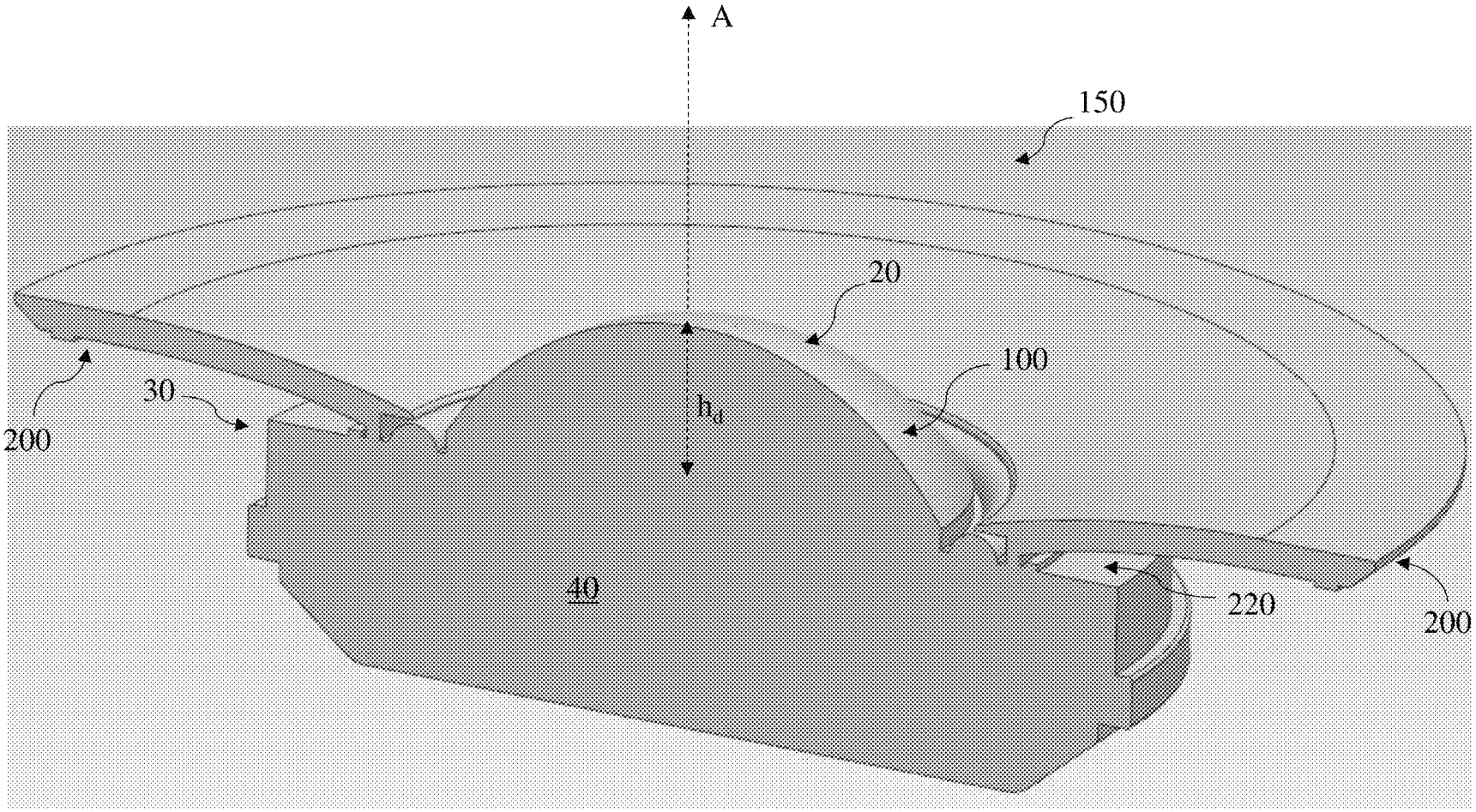
FIG. 2A PRIOR ART
FIG. 2A shows a perspective cut-away view of a conventional waveguide.
Figure 2B:
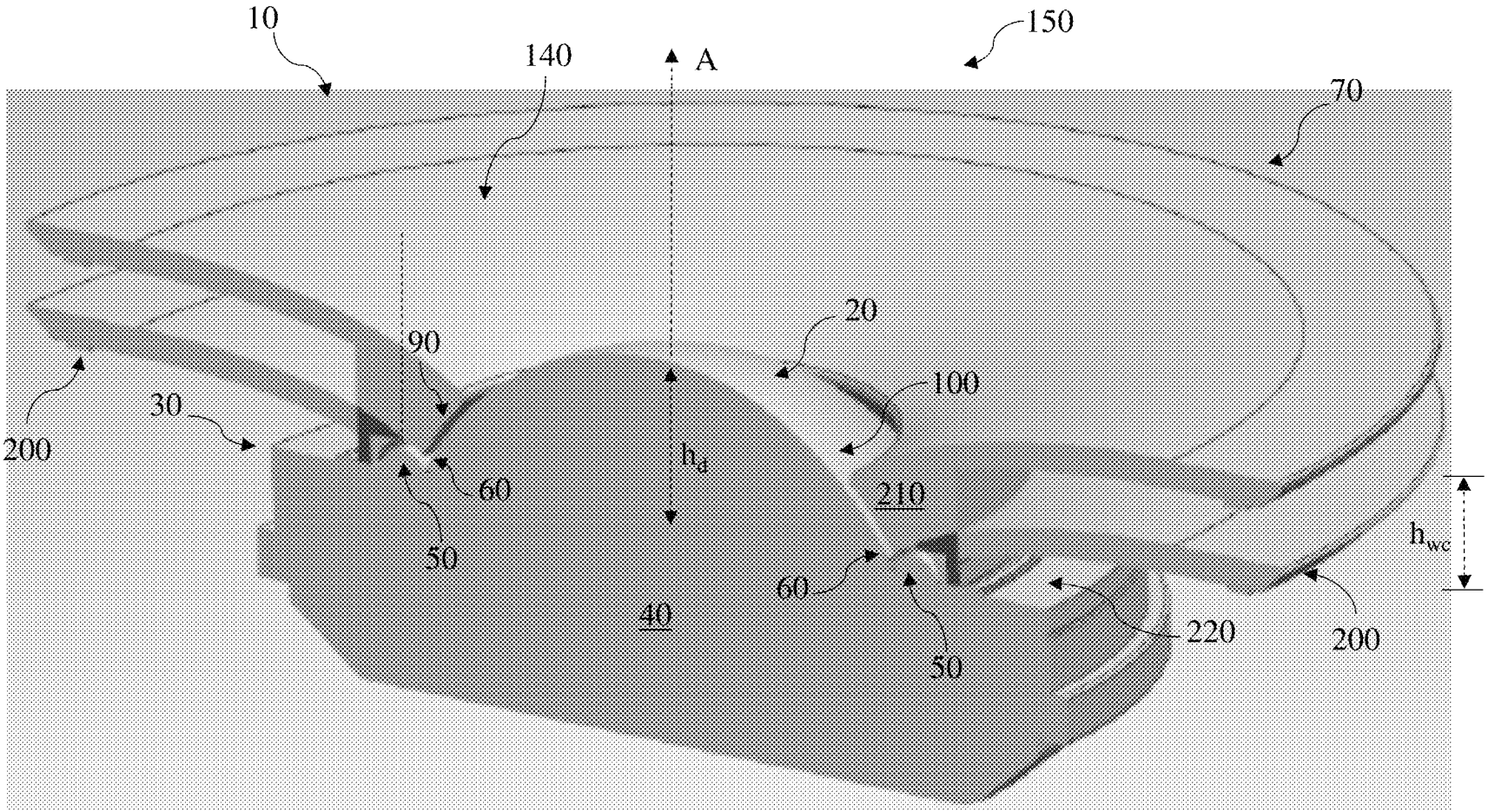
FIG. 2B shows a perspective cut-away view of the conventional waveguide of FIG. 2A, overlain by the loudspeaker of FIG. 1.
Figure 3:
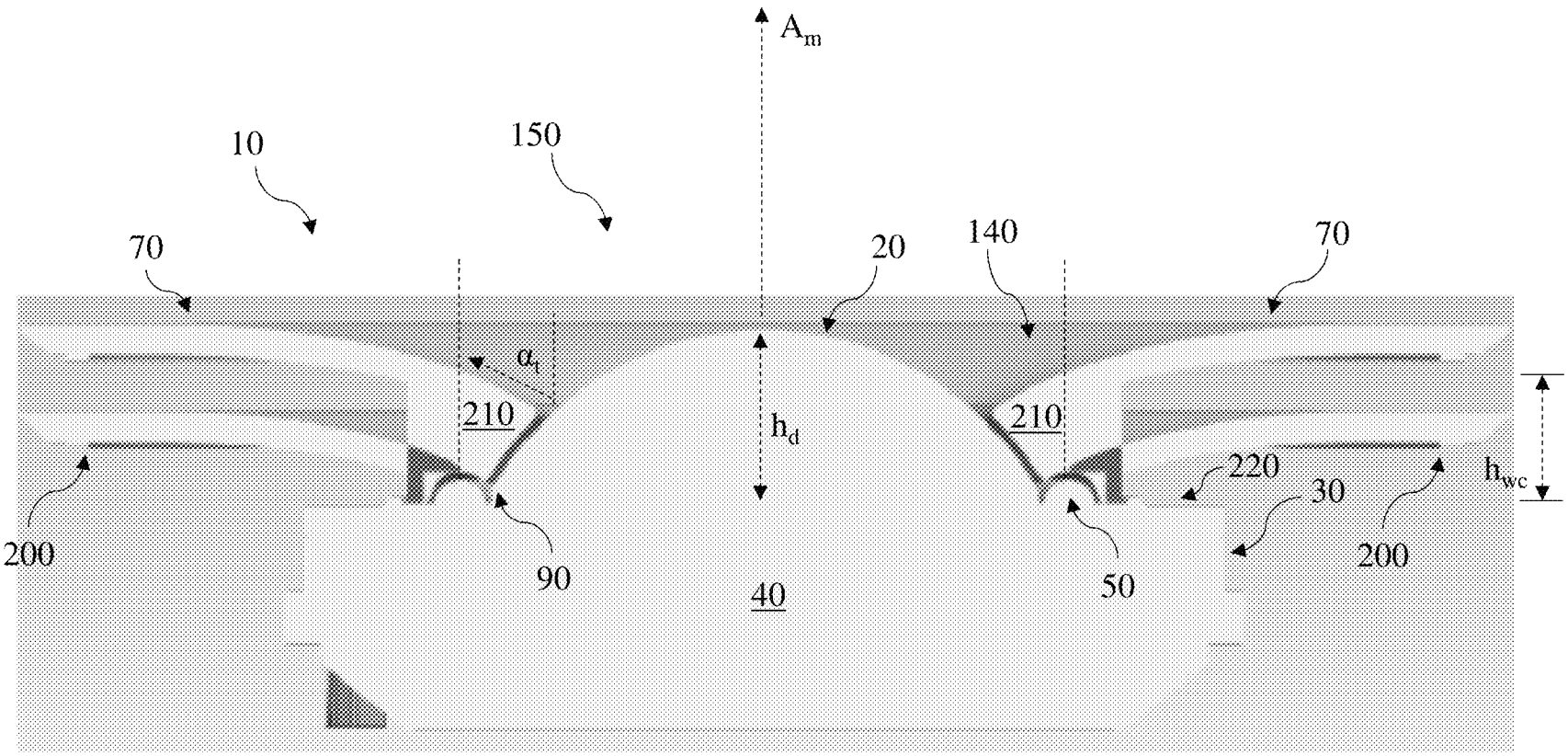
FIG. 3 shows an additional cut-away perspective view of the conventional waveguide of FIG. 2A, overlain by the loudspeaker of FIG. 1.

As can be seen in FIGS. 1-3, with particular reference to FIG. 2B, the waveguide 70 in loudspeaker 10 overhangs the surround 50 in various implementations. In particular, a core (or radially inner) section 210 of the waveguide 70 overhangs the surround 50 in these cases. In this sense, the surround 50 is visually obstructed by the waveguide 70 from the front 150 of the loudspeaker 10. In particular cases, the waveguide 70 visually obstructs the entire surround 50 as viewed from the front 150 of the loudspeaker 10. This is contrasted with the conventional waveguide 200 (FIG. 2A, FIG. 2B, FIG. 3), which does not overhang the surround 50 in such a way as to visually obstruct the surround 50 from the front 150 of the loudspeaker. This is further illustrated in FIGS. 2B and 3, by the dashed vertical lines showing the radial extent of the conventional waveguide 200.

In particular examples, the core section 210 of the waveguide 70 has a height ($h_{wc}$) as measured from the outer surface 220 of the basket 30 (in an axial direction parallel with the motion axis ($A_m$)) that is equal to approximately 35 percent to approximately 85 percent (and in some particular examples, approximately 50 percent) of a height ($h_d$) of the diaphragm 20 as measured from the outer surface 220 of the basket 30 in the axial direction. As seen in FIGS. 2B and 3, some examples of the waveguide 70 have a core section height that is approximately twice the height of the core section of the conventional waveguide 200.

It is understood that the electro-magnetic motor 40 can be coupled with one or more control circuits (not depicted) for providing electrical signals to excite the diaphragm 20. The control circuit(s), where applicable, can include a processor and/or microcontroller, which in turn can include decoders, DSP hardware/software, etc. for playing back (rendering) audio content at the loudspeaker 10. The control circuit(s) can also include one or more digital-to-analog (D/A) converters for converting the digital audio signal to an analog audio signal. This audio hardware can also include one or more amplifiers which provide amplified analog audio signals to the loudspeaker 10.

One or more components in the loudspeaker 10 can be formed of any conventional loudspeaker material, e.g., a heavy plastic, metal (e.g., aluminum, or alloys such as alloys of aluminum), composite material, etc.

In operation, the control circuit in loudspeaker 10 is configured to convert an electrical signal to an acoustic output at the diaphragm 20. As noted herein, the waveguide 70 is configured such that the acoustic output of the loudspeaker 10 has a sound radiation pattern that remains wide despite its impression as a small acoustic source.

In contrast to conventional loudspeakers, loudspeaker 10 can provide a low-profile (e.g., flush-mounted or surface-mounted) speaker configuration with a wider radiation pattern at higher frequencies (e.g., 8 kHz or higher).

It is understood that the relative proportions, sizes and shapes of the loudspeaker 10 and components and features thereof as shown in the FIGURES included herein can be merely illustrative of such physical attributes of these components. That is, these proportions, shapes and sizes can be modified according to various implementations to fit a variety of products. For example, while a substantially circular-shaped loudspeaker may be shown according to particular implementations, it is understood that the loudspeaker could also take on other three-dimensional shapes in order to provide acoustic functions described herein.

In various implementations, components described as being "coupled" to one another can be joined along one or more interfaces. In some implementations, these interfaces can include junctions between distinct components, and in other cases, these interfaces can include a solidly and/or integrally formed interconnection. That is, in some cases, components that are "coupled" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other implementations are within the scope of the following claims.

I claim:

1. A loudspeaker comprising:

a diaphragm;

a basket;

an electro-magnetic motor supported by the basket and coupled to the diaphragm for driving motion of the diaphragm relative to the basket along a motion axis;

a surround coupling an outer peripheral edge of the diaphragm to the basket; and a waveguide coupled to the basket and surrounding the diaphragm, wherein the waveguide has an arcuate inner surface that is complementary with an arcuate outer surface of the diaphragm and extends along a portion of the arcuate outer surface of the diaphragm, wherein the arcuate inner surface of the waveguide extends along approximately 5 percent to approximately 40 percent of the outer surface of the diaphragm.

2. The loudspeaker of claim 1, wherein the waveguide further comprises an outer surface that extends beyond the outer peripheral edge of the diaphragm.

3. The loudspeaker of claim 1, wherein the waveguide overhangs the surround.

4. The loudspeaker of claim 3, wherein a core of the waveguide overhangs the surround, the core having a height as measured from the outer surface of the basket in a direction parallel with the motion axis that is equal to approximately 35 percent to approximately 85 percent of a height of the diaphragm as measured from the outer surface of the basket in the axial direction.

5. The loudspeaker of claim 1, wherein the surround is visually obstructed by the waveguide from a front of the loudspeaker, and wherein the loudspeaker comprises a gap between the surround and a core of the waveguide.

6. The loudspeaker of claim 1, wherein the arcuate inner surface of the waveguide is separated from the arcuate outer surface of the diaphragm by a distance of approximately 0.25 millimeters (mm) to approximately 0.75 mm when the diaphragm is in its rest position.

7. The loudspeaker of claim 1, wherein the arcuate inner surface of the waveguide extends along only a portion of the outer surface of the diaphragm such that a distinct portion of the outer surface of the diaphragm is exposed through an opening in the waveguide.

8. The loudspeaker of claim 1, wherein the diaphragm comprises a dome-shaped radiating surface.

9. The loudspeaker of claim 1, wherein the loudspeaker comprises a high frequency (HF) driver.

10. A high frequency (HF) driver comprising:

a diaphragm;

a basket;

a surround coupling an outer peripheral edge of the diaphragm to the basket and protruding from an outer surface of the basket; and a waveguide coupled with the basket and surrounding the diaphragm, wherein the waveguide comprises:

an arcuate inner surface that is complementary with an arcuate outer surface of the diaphragm and overlies a portion of the arcuate outer surface of the diaphragm, such that the outer peripheral edge of the diaphragm is visually obstructed by the waveguide from a front of the loudspeaker, wherein a core of the waveguide overhangs the surround, the core having a height as measured from the outer surface of the basket in a direction parallel with the motion axis that is equal to approximately 35 percent to approximately 85 percent of a height of the diaphragm as measured from the outer surface of the basket in the axial direction.

11. The HF driver of claim 10, wherein the waveguide overhangs the surround.

12. The HF driver of claim 10, wherein the surround is visually obstructed by the waveguide from a front of the loudspeaker.

13. The HF driver of claim 10, wherein the arcuate inner surface of the waveguide is separated from the arcuate outer surface of the diaphragm by a distance of approximately 0.25 millimeters (mm) to approximately 0.75 mm.

14. The HF driver of claim 10, wherein the arcuate inner surface of the waveguide extends along approximately 5 percent to approximately 40 percent of the outer surface of the diaphragm.

15. The HF driver of claim 10, wherein the diaphragm comprises a dome-shaped radiating surface.

16. A loudspeaker comprising:

a diaphragm;

a basket;

an electro-magnetic motor supported by the basket and coupled to the diaphragm for driving motion of the diaphragm relative to the basket along a motion axis;

a surround coupling an outer peripheral edge of the diaphragm to the basket; and a waveguide coupled to the basket and surrounding the diaphragm, wherein the waveguide has an arcuate inner surface that is complementary with an arcuate outer surface of the diaphragm and extends along a portion of the arcuate outer surface of the diaphragm, wherein the loudspeaker comprises a gap between the surround and a core of the waveguide, wherein the core of the waveguide overhangs the surround and a gap exists between the core of the waveguide and the surround, and wherein a core of the waveguide overhangs the surround, the core having a height as measured from the outer surface of the basket in a direction parallel with the motion axis that is equal to approximately 35 percent to approximately 85 percent of a height of the diaphragm as measured from the outer surface of the basket in the axial direction.

17. The loudspeaker of claim 16, wherein the arcuate inner surface of the waveguide extends along only a portion of the outer surface of the diaphragm such that a distinct portion of the outer surface of the diaphragm is exposed through an opening in the waveguide.

* * * * *